US007014052B2

(12) United States Patent
Dettorre et al.

(10) Patent No.: US 7,014,052 B2
(45) Date of Patent: Mar. 21, 2006

(54) WALL HANGER AND SPACER FOR SKATEBOARDS AND SCOOTERS

(76) Inventors: Ross D. Dettorre, 2598 Wandering Ridge, Chino Hills, CA (US) 91709; David K. Nygren, 1213 E. Grove Pl., Fullerton, CA (US) 92831; Richard D. Lutz, 410 Manti Dr., Anaheim, CA (US) 92807

( * ) Notice: Subject to any disclaimer, the term of this patent is extended or adjusted under 35 U.S.C. 154(b) by 0 days.

(21) Appl. No.: 10/120,024

(22) Filed: Apr. 9, 2002

(65) Prior Publication Data

US 2002/0144962 A1 Oct. 10, 2002

Related U.S. Application Data

(60) Provisional application No. 60/282,102, filed on Apr. 9, 2001, provisional application No. 60/288,011, filed on May 1, 2001.

(51) Int. Cl.
*A47F 7/00* (2006.01)

(52) U.S. Cl. ..... 211/85.7; 211/18; 211/60.1; 211/86.01; 211/94.01

(58) Field of Classification Search ..... 211/18, 211/23, 35, 60.1, 66, 71.01, 85.7, 87.01, 89.01, 211/94.01, 106.01, 162; 248/214, 215, 220.21, 248/223.41, 223.51, 223.61, 225.11, 251, 248/304, 305, 307, 309.1, 311.2, 331.3, 339; D6/566, 552
See application file for complete search history.

(56) References Cited

U.S. PATENT DOCUMENTS 434,819 A * 8/1890 Beckman ..... 211/65
2,243,947 A * 6/1941 Epstein ..... 211/35
2,329,088 A * 9/1943 Schram et al. ..... 211/17
2,805,777 A * 9/1957 Larson ..... 211/70.1
3,698,563 A * 10/1972 Gordon et al. ..... 211/85.7
4,193,495 A * 3/1980 Keeley ..... 294/143
4,203,175 A * 5/1980 Heine ..... 5/503.1
4,289,243 A * 9/1981 Arbuzoff ..... 211/35
4,460,094 A * 7/1984 Schoen ..... 211/35
4,469,231 A * 9/1984 Hehn ..... 211/11
4,530,168 A * 7/1985 Petre ..... 34/106
4,771,897 A * 9/1988 Ho ..... 211/85.9
4,968,048 A * 11/1990 Lortie ..... 280/47.19
5,120,012 A * 6/1992 Rosenau ..... 248/201
5,203,462 A * 4/1993 Brooks ..... 211/14
5,301,818 A * 4/1994 Dix ..... 211/85.7
5,305,897 A * 4/1994 Smith ..... 211/85.7
5,316,155 A * 5/1994 Collins et al. ..... 211/70.5
D354,872 S * 1/1995 Dix ..... D6/552
D356,002 S * 3/1995 Morgan ..... D6/552
5,626,244 A * 5/1997 Mesna et al. ..... 211/60.1
5,687,856 A * 11/1997 Kendrena ..... 211/70.6
5,702,006 A * 12/1997 Durham ..... 211/18
5,727,698 A * 3/1998 Lai ..... 211/87.01

(Continued)

*Primary Examiner*—Jennifer E. Novosad
(74) *Attorney, Agent, or Firm*—Terry L. Miller; Donald W. Meeker

(57) ABSTRACT

A small flat wall mountable panel having a flat visual display surface has two spaced apart upwardly arched hooks mounted on backstop spacers and aligned horizontally to receive a skateboard wheel mount or a scooter handle bar therein. An outwardly arched spacer arm below the hooks contacts the board or scooter to maintain the skateboard or scooter away from the wall. A rail with a sliding track can receive and mount a number of the hanger/spacer devices horizontally aligned on a wall. End caps and interconnectors between rails have flat surfaces for visual displays.

11 Claims, 2 Drawing Sheets

U.S. PATENT DOCUMENTS 5,823,360 A * 10/1998 Gorosave ..... 211/13.1
5,897,002 A * 4/1999 Carlino ..... 211/70.6
D421,082 S * 2/2000 Lopez ..... D21/771
6,152,312 A * 11/2000 Nava et al. ..... 211/94.01
6,199,880 B1 * 3/2001 Favorito et al. ..... 280/87.042
6,293,412 B1 * 9/2001 Draper ..... 211/4
6,390,309 B1 * 5/2002 Tucker ..... 211/85.7
6,435,357 B1 * 8/2002 Lee ..... 211/70.6

* cited by examiner

WALL HANGER AND SPACER FOR SKATEBOARDS AND SCOOTERS

CLAIM OF PROVISIONAL APPLICATION RIGHTS

This application claims the benefit of U.S. Provisional Patent Applications Ser. No. 60/282,102, filed on Apr. 9, 2001 and No. 60/288,011, filed on May 1, 2001.

BACKGROUND OF THE INVENTION

1. Field of the Invention

The present invention relates to wall hangers for extreme recreational sports equipment and in particular to a wall hanger with a single hanger unit that holds the end of a skateboard or a scooter up on a pair of hooks and keeps the wheels and other parts of the skateboard and scooter away from contact with the wall by means of a spacer arm.

2. Description of the Prior Art

Storage and display are always problems in any home or business never seems to be enough space to store everything in a way that makes access easy for retrieving the stored items.

Some items which are used constantly or having particular meaning or attractive appearance are desirable to store in visible locations with very easy access. Skate boards and Razor-type scooters fall into all of these categories for avid users of these devices.

Wall storage can be a good solution for items such as these. The items stored on the wall are highly visible and easily accessible. However there is a problem with marring the wall, especially with these recreational devices that are used outdoors and are likely to have dirt or tar or other matter on the wheels that would make hard to remove spots on the wall if the wheels came into contact with the wall.

Some attempts have been made at wall storage for skateboards and Razor-type scooters. None have solved the problem of provided a simple inexpensive wall hanging hook for hanging a skateboard or a scooter and at the same time keeping the wheels from contacting the wall.

U.S. Pat. No. 5,305,897, issued Apr. 26, 1994 to Smith, provides a wall mounted skateboard storage rack having two upper cradles with side walls to support one set of wheels and an elongated plate extending downwardly with side walls to receive the lower set of wheels resting on the elongated plate with the lower side walls to prevent side motion of the lower wheels and maintain the skateboard in a vertical orientation.

U.S. Pat. No. 5,120,012, issued Jun. 09, 1992 to Rosenau, shows an apparatus for detachably mounting a skateboard or skates having an elongated wall mounted board with an upper and lower flexible clips for retaining the two sets of skateboard wheels between the clips with both sets of wheels contacting the board.

U.S. Pat. No. 5,301,818, issued Apr. 12, 1994 to Dix, claims a support rack for a skateboard having a small wall-mounted support plate with a pair of upper wheel supports to support a pair of wheels on the skateboard with the skateboard hanging downwardly and the other pair of wheels contacting the wall.

U.S. Pat. No. Des. 421,082, issued Feb. 22, 2000 to Lopez, shows the design of a hanger for a skateboard with receptacles for a pair of wheels and a portion of the wheel support, which would have the other pair of wheels contacting the wall.

U.S. Pat. No. 6,199,880, issued Mar. 13, 2001 to Favorito, provides a convertible skateboard/scooter with a fold-down handle. The handle can be used for carrying the scooter or hanging the scooter in the fold down position. A hanger for the scooter is not claimed.

U.S. Pat. Nos. 2,329,088, issued Apr. 13, 1942 to Schram and U.S. Pat. No. 5,702,006, issued Dec. 30, 1997 to Durham, both show a double hook element for supporting the handle bar of a bicycle to support the bicycle in a vertical position. The Schram patent just holds the bike up with the rear tire on the ground. The Durham patent has a wall-mounted handle bar hook with an additional holder for the bicycle seat to retain the bike in a vertical orientation against the wall. Neither patent has a means for holding the bicycles away from the wall.

U.S. Pat. No. 5,316,155, issued May 31, 1994 to Collins, shows a ski rack mounted on a wall with a double hook element to support a pair of skis by one end of the ski binding with a second double hook element to retain the other end of the ski binding, with both hooks maintaining the skis in a vertical position against the wall. No element is provided to keep the skis out away from the wall.

U.S. Pat. Nos. 4,968,048, issued Nov. 6, 1990 to Lortie and U.S. Pat. No. 4,193,495, issued Mar. 18, 1980 to Keeley both claim supports for holding baseball bats in a vertical orientation. The Lortie invention has a slot at the top to receive the small end of the bat with the knob on the end being wider than the slot to hold the bat up. A circular hole in a base keeps the wide end of the bat from moving around. The Keeley patent has upper and lower two piece clamps for gripping the bat to hold it in a vertical orientation. Only in the Lortie patent is there a provision made for keeping the lower end of the bat from contacting the vertical support surface.

U.S. Pat. No. 434,819, issued Jul. 19, 1890 to Beckmann shows a two-sided wall-mounted support for brooms to hold them in a vertical orientation against the wall with the head of the broom resting across the support and the handle hanging down between the sides of the support. No provision is made to keep the brooms away from the wall.

None of the prior art patents have a simple hook support which also by itself holds the bottom wheels away from the wall provides an advantage over the prior patents in keeping the wheels from contacting the wall with a relatively small hanging mechanism compared to the large plates of the first two patents and makes your invention unique and patentable.

SUMMARY OF THE INVENTION

An object of the present invention is to provide a hanger and spacer for a skateboard or scooter for wall mounting them by hooking an axle of one set of wheels of the skateboard or the handle bar of the scooter on a pair of hooks positioned outwardly from a flat wall plate on a backstop and spacer supporting the hooks to keep the top wheels of the skateboard and the handle bars of the scooter away from the wall and having a lower spacer arm extending from the hook to space the remainder of the skateboard and scooter away from the wall.

Another object of the present invention is to provide a wall mounting hook that is easy and inexpensive to manufacture in a single piece by an injection molding process.

A further object of the present invention is to provide a hanger and spacer that is injection molded using a plastic resin mixed with dyes to match the colors of the skateboard or scooter, especially appealing in a retail display selling skateboards or scooters.

A related object of the present invention is to provide a hanger and spacer with a flat plate wall mount base with ample flat space for an advertisement, insignia, logo, design, personal statement or other type of visual display.

A corollary object of the present invention is to provide a horizontal rail with a slot for hanging a series of skateboards or scooters in a horizontal array, the rail having flat spaces in an end piece and a connector for an advertisement, insignia, logo, design, personal statement or other type of visual display.

An additional object of the present invention is to provide a rail with a slidable groove for creating a quick mountable and movable array of hooks for wall mounting skateboards and scooters.

Again another object of the present invention is to provide durable built-up hooks and a resilient memory plastic spacer arm to resist breakage and distortion over time.

In brief a single wall mountable hook element with two spaced apart upwardly curving hooks to support one set of wheels of a skateboard or a T-shaped element, such as a scooter handle, has a lower spacer arm extending downwardly from the hooks having an outwardly curving portion to contact the underside of the skateboard or scooter handlebar support post and maintain the other wheels and parts of the skate board or scooter away from the wall.

The compact hanger with hooks and extending spacer arm can be easily and inexpensively manufactured from a single mold using injection molding techniques.

A rail with a sliding track enables the quick and easy mounting of a number of hangers aligned in a movable array on the wall.

Advertising space or space for other types of images are provided on the flat plate of the hanger and on the connectors and end pieces of the horizontal rail.

An advantage of the present invention is that is presents a simple solution to the problem of storage and/or display of skateboards and scooters with a small wall mounted hanger and spacer and an additional rail for mounting a number of the hangers.

Another advantage of the present invention is that it protects the wall from marks or damage from the wheels or other parts of skateboards and scooters with a minimal hanging element which does not take up much wall space.

A further advantage of the present invention is that it provides an attractive display means for showing skateboards and scooters for sale with several advertising spaces on the hanger and rail.

One more advantage of the present invention is that it provides a long-lasting hanger with built-up hook and resilient memory spacer arms that resist breaking and distortion.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
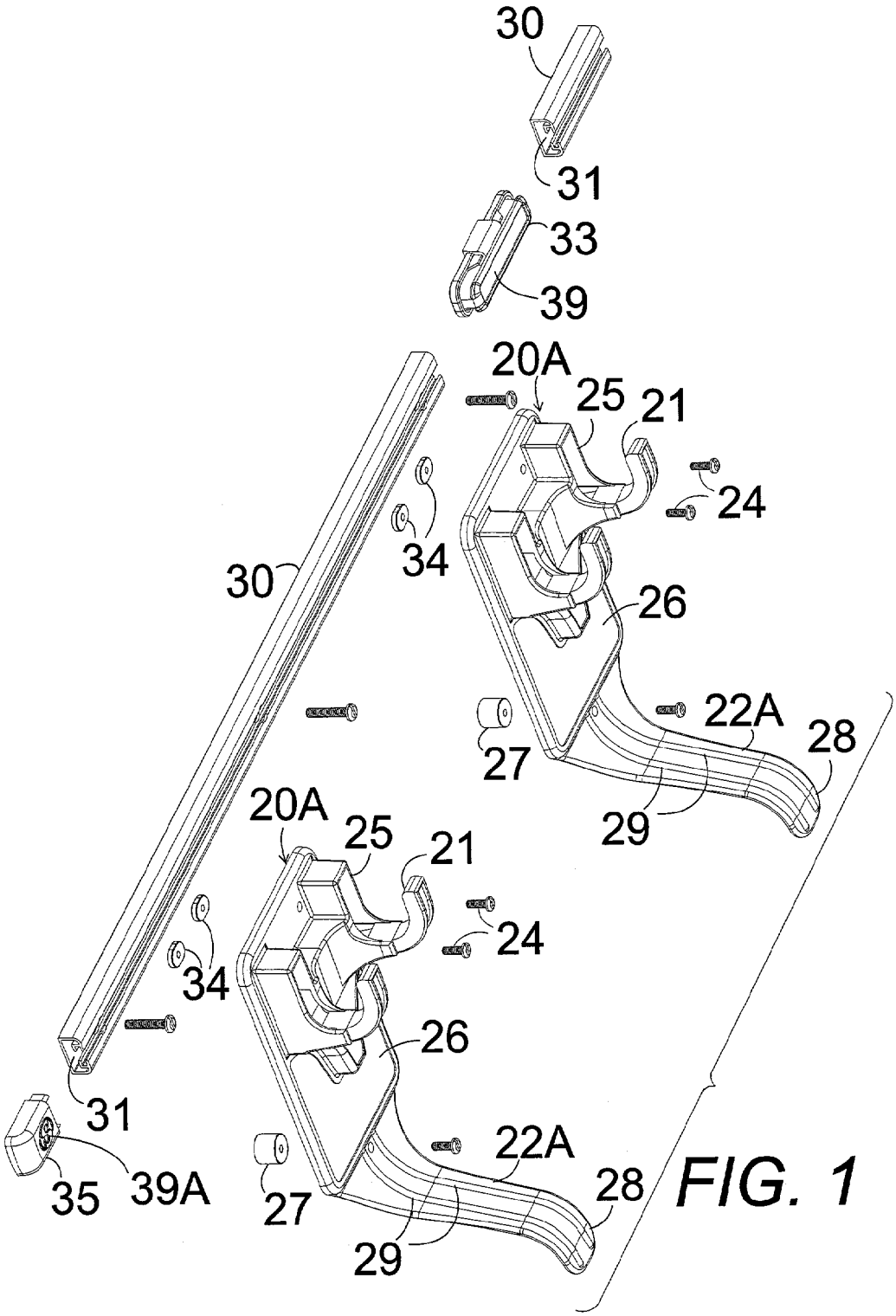
FIG. 1 is a perspective view of two skateboard hangers with spacers aligned for mounting on a wall rail with a sliding groove.
Figure 2:
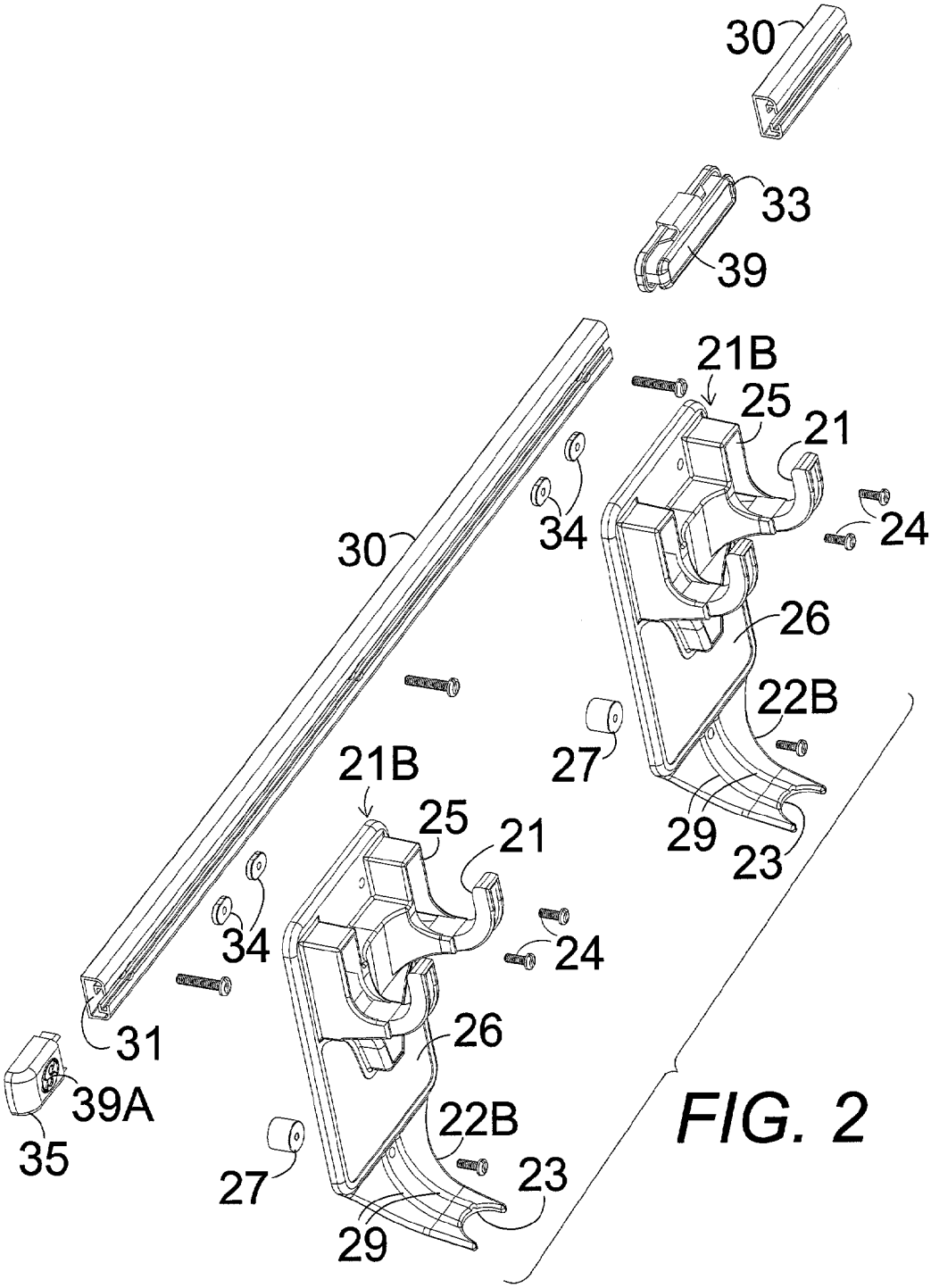
FIG. 2 is a perspective view of two scooter hangers with spacers aligned for mounting on a wall rail with a sliding groove.

In FIGS. 1 and 2, a wall hanger and spacer 20A and 20B, for mounting wheeled recreational equipment on a wall while maintaining the equipment away from contact with the wall, comprises a panel 26 with hooks 21 and spacer arm 22A and 22B.

A flat panel 26 having a flat exposed surface for visual displays, such as advertising or other visual indicia, is mountable on a wall with screws or other conventional wall mounting means. The panel 26 has spaced apart upwardly curving hooks 21 horizontally aligned and spaced outwardly from the panel on a built-up backstop spacer 25 to receive and support a horizontally extending portion of a piece of wheeled recreational equipment retained by the hooks with the horizontally extending portion maintained away from contact with the wall. Below the hooks, a spacer arm 22A and 22B protrudes outwardly from the panel 26 to contact a downwardly extending portion of the piece of wheeled recreational equipment to maintain the piece of recreational equipment away from contact with the wall. The spacer arms 22A and 22B are fabricated with two radiuses 29 extending the length of the spacer arms of a proper gauge of thickness and utilizing a plastic resin injection molding material having proper characteristics to create durable resilient spacer arms with built in memory so that any distortion of the spacer arms from having the equipment pressed against them enable the spacer arms to always bounce back to their original shape to maintain the equipment away from the wall and to retain their shape over time thereby extending the life of the hanger and spacer.

The hanger and spacer 20A and 20B may be mounted directly on the wall or on an elongated rail 30 mountable horizontally on a wall by a wall mounting means, such as screws or other wall mounting means. The rail 30 has a track 31, comprising a long narrow slot opening into a wider channel, along its length for receiving at least one slidable element, such as a threaded washer 34 and screw 24 from the hanger and spacer 20A and 20B, the slidable element 34 capable of sliding within the track and supporting the hanger and spacer on the rail. A spacer element 27 is positionable between the wall and the panel 26 below the rail 30 to maintain the panel 26 in a vertical orientation. End caps 35 and interconnectors 33 for interconnecting a series of horizontal rails 30 are both provided with flat display surfaces 39A and 39, respectively, for visual displays such as advertising and other indicia.

In FIG. 1 the hooks 21 are configured to receive a set of wheels and wheel mounts from a skateboard therein while maintaining the wheels away from the wall and the spacer arm 22A extends outwardly from the wall a sufficient distance with an arched contact end 28 to contact a board portion of the skateboard to maintain the skateboard away from contact with the wall. The hooks 21 may receive the wheels or the axle mount for the wheels.

In FIG. 2 the same sized and shaped hooks 21 as those of FIG. 1 are configured to receive a handle bar from a scooter therein while maintaining the handle bar away from the wall and the spacer arm 22B extends outwardly from the wall a sufficient distance to contact a vertical handle bar support to maintain the scooter away from contact with the wall with the scooter in a folded up configuration. The spacer arm 22B is provided with a recessed arched receiving tip 23 on an outer end of the spacer arm for receiving the vertical handle bar support therein to prevent lateral movement of the scooter.

In practice the hanger and spacer 20A and 20B may be mounted on the wall or in a series on a horizontal rail 30. A skateboard is hung by the wheels or wheel mounts on the hooks 21, of FIG. 1, and the skateboard and other wheels are maintained away from the wall by the spacer arm 28 contacting the board.

A scooter, such as a Razor scooter, is folded up and the horizontal handle bar is hung on the hooks 21, of FIG. 2, while the spacer arm 22B receives the vertical handle bar support in the receiving tip 23 to maintain the scooter away from the wall.

The hanger and spacer 20A and 20B is preferably injection molded in one piece of durable resin plastic with color dyes and possibly metal flakes for attractive colorful hangers and rails which may match the colors and designs on the skateboards and scooters.

It is understood that the preceding description is given merely by way of illustration and not in limitation of the invention and that various modifications may be made thereto without departing from the spirit of the invention as claimed.

What is claimed is:

1. A compact wall hanger and spacer configured for hanging a skateboard or foldable scooter on a wall while maintaining the skateboard or foldable scooter away from contact with the wall, comprising:

a panel mountable on a wall, said panel having a pair of spaced apart upwardly curving integral hooks horizontally aligned and extending outwardly from said panel, said pair of hooks being spaced outwardly from said panel on an integral backstop spacer, and said pair of hooks being sized and spaced apart for receiving and supporting a horizontally extending portion of a skateboard or foldable scooter which is retained by and hangs generally dependent below the pair of hooks with the horizontally extending portion maintained away from contact with the wall by the backstop spacer, and spaced below the hooks, an integral resilient spacer arm protruding outwardly from the panel a distance for contacting a downwardly extending portion of the skateboard or foldable scooter to maintain all other portions of the skateboard or foldable scooter away from contact with the wall;

wherein the wall hanger and spacer is formed as a single unitary hanger unit manufactured as a single monolithic injection molded piece.

2. The hanger and spacer of claim 1 wherein the panel further comprises a flat exposed surface for visual displays.

3. The hanger and spacer of claim 1 wherein the hanger and spacer further comprises at least one slidable element attached thereon and mounting means comprising an elongated rail mountable horizontally on a wall by a wall mounting means, the rail having a track along its length for receiving said at least one slidable element on the hanger and spacer, the slidable element adapted for sliding within the track and supporting the hanger and spacer on the rail.

4. The hanger and spacer of claim 3 wherein the elongated rail comprises two sections having mating ends, and further comprising at least one interconnector which snap fits into the mating ends of said two sections of elongated rails.

5. The hanger and spacer of claim 4 wherein the interconnector further comprises a flat exposed surface for visual displays.

6. The hanger and spacer of claim 3 further comprising a pair of end caps which snap fit into each end of the elongated rail, the end caps each provided with a flat exposed surface for visual displays.

7. The hanger and spacer of claim 3 further comprising a spacer element positionable between the wall and the panel below the rail to maintain the panel in a vertical orientation.

8. The hanger and spacer of claim 1 wherein said pair of hooks are configured to receive therein a wheel mount of a skateboard, and the backstop spacer is adapted to maintain the wheels at said wheel mount away from the wall, and the spacer arm is adapted to extend outwardly from the wall a distance to contact a board portion of the skateboard to maintain the skateboard away from contact with the wall.

9. The hanger and spacer of claim 8 wherein said pair of hooks are further configured to receive a handle bar of a folded scooter therein, and the backstop spacer is adapted to maintain the handle bar away from the wall and the spacer arm is adapted to extend outwardly from the wall a distance to contact a vertical handle bar support to maintain the folded scooter away from contact with the wall.

10. The hanger and spacer of claim 9 wherein the spacer arm is provided with an arched receiving tip on an outer end of the spacer arm for receiving the vertical handle bar support therein.

11. The hanger and spacer of claim 1 wherein the hanger and spacer is fabricated of injection molded resin plastic mixed with colored dyes.

* * * * *